United States Patent [19]

Guenther

[11] 4,169,434

[45] Oct. 2, 1979

[54] INTERNAL COMBUSTION ENGINE WITH STEPPED PISTON SUPERCHARGER

[75] Inventor: William D. Guenther, Hagerstown, Ind.

[73] Assignee: Dana Corporation, Toledo, Ohio

[21] Appl. No.: 796,570

[22] Filed: May 13, 1977

[51] Int. Cl.[2] ..... F01L 11/02; F02B 33/12; F01L 7/02

[52] U.S. Cl. ..... 123/47 A; 123/59 BS; 123/75 CC; 123/190 BF

[58] Field of Search ..... 123/47 A, 47 R, 51 A, 123/51 B, 59 BS, 65 S, 73 E, 73 F, 75 CC, 75 RC, 193 CP, 193 P, 73 V, 190 BF, 190 BE, 190 B, 190 R, 190 BB; 92/107, 177

[56] References Cited

U.S. PATENT DOCUMENTS

| | | | |
|---|---|---|---|
| 612,047 | 10/1898 | Millen | 123/56 B |
| 981,331 | 1/1911 | Twitchell | 123/59 BS |
| 989,391 | 4/1911 | Moser | 123/59 BS |
| 1,771,552 | 7/1930 | Tower | 123/73 V |
| 2,085,547 | 6/1937 | Schrom | 92/177 |
| 3,574,997 | 4/1971 | Syrovy | 123/47 A |
| 3,948,227 | 4/1976 | Guenther | 123/190 B |
| 3,973,532 | 8/1976 | Litz | 123/75 CC |
| 4,027,632 | 6/1977 | Wagner | 123/47 R |

FOREIGN PATENT DOCUMENTS

| | | | |
|---|---|---|---|
| 332131 | 7/1930 | United Kingdom | 123/51 B |
| 332144 | 7/1930 | United Kingdom | 123/51 B |

*Primary Examiner*—Charles J. Myhre
*Assistant Examiner*—Craig R. Feinberg
*Attorney, Agent, or Firm*—Robert M. Leonardi; Robert E. Pollock

[57] ABSTRACT

A reciprocating piston four cycle internal combustion engine utilizes a stepped piston the stepped portion of which, working in an enlarged bore in the block, serves as a compressor to provide a supercharged fuel-air mixture to the combustion chamber. The compressor delivers two compression strokes per engine cycle. The compressed fuel-air mixture travels from the compressor via a bypass manifold, which also serves as an accumulator, to the main cylinder via an intake valve. Fuel-air mixture is admitted to the compressor cylinder through the crankcase and valved passages through the stepped portion of the piston.

8 Claims, 10 Drawing Figures

INTERNAL COMBUSTION ENGINE WITH STEPPED PISTON SUPERCHARGER

BACKGROUND OF THE INVENTION

This invention relates to reciprocating piston internal combustion engines and particularly to such engines having internal superchargers.

Trends in engine design are always for more horsepower for a given engine displacement, size and weight. At the same time fuel efficiency is, in many applications, an important consideration. As is well known to those skilled in this art, a typical two cycle engine delivers significantly more horsepower per cubic inch displacement at a given rpm than any production, naturally aspirated four cycle engine, but it is a substantially less efficient engine. Super-charged four cycle engines represent a compromise of sorts providing more power per unit weight than conventional four cycle engines and better fuel economy than two cycle engines. Superchargers, however, generally are expensive and have found substantial use only in the racing car field. Accordingly, it is the principal object of the present invention to provide a relatively simple, efficient supercharger for a four cycle engine.

SUMMARY OF THE INVENTION

An internal combustion engine in accordance with the present invention employs a stepped piston with a first portion of the piston working in the conventional way as the movable wall of the combustion chamber. A stepped, or enlarged diameter, portion operates in an adjacent, axially aligned, bore of the cylinder. The stepped portion of the piston is ported and check valves are provided at the ports which permit a one way flow of fuel-air mixture from the engine crankcase into the compressor portion of the engine comprising the stepped portion of the piston and the bore in which it is working. This arrangement provides two intake and two compression strokes of the compressor per four cycle combustion cycle. The mixture which enters the compressor on the down-stroke of the piston is trapped by the check valves, compressed on the up stroke and delivered into a bypass and accumulator manifold connected to the intake valve for the main cylinder. Thus the compressor system of the present invention is effective to transfer two charges per combustion cycle into the bypass manifold and serves as a supercharger providing a simple high performance four cycle engine with a high horsepower for a given weight or displacement.

DESCRIPTION OF THE PREFERRED EMBODIMENTS

Figures 1, 2, 3, 4, 5:
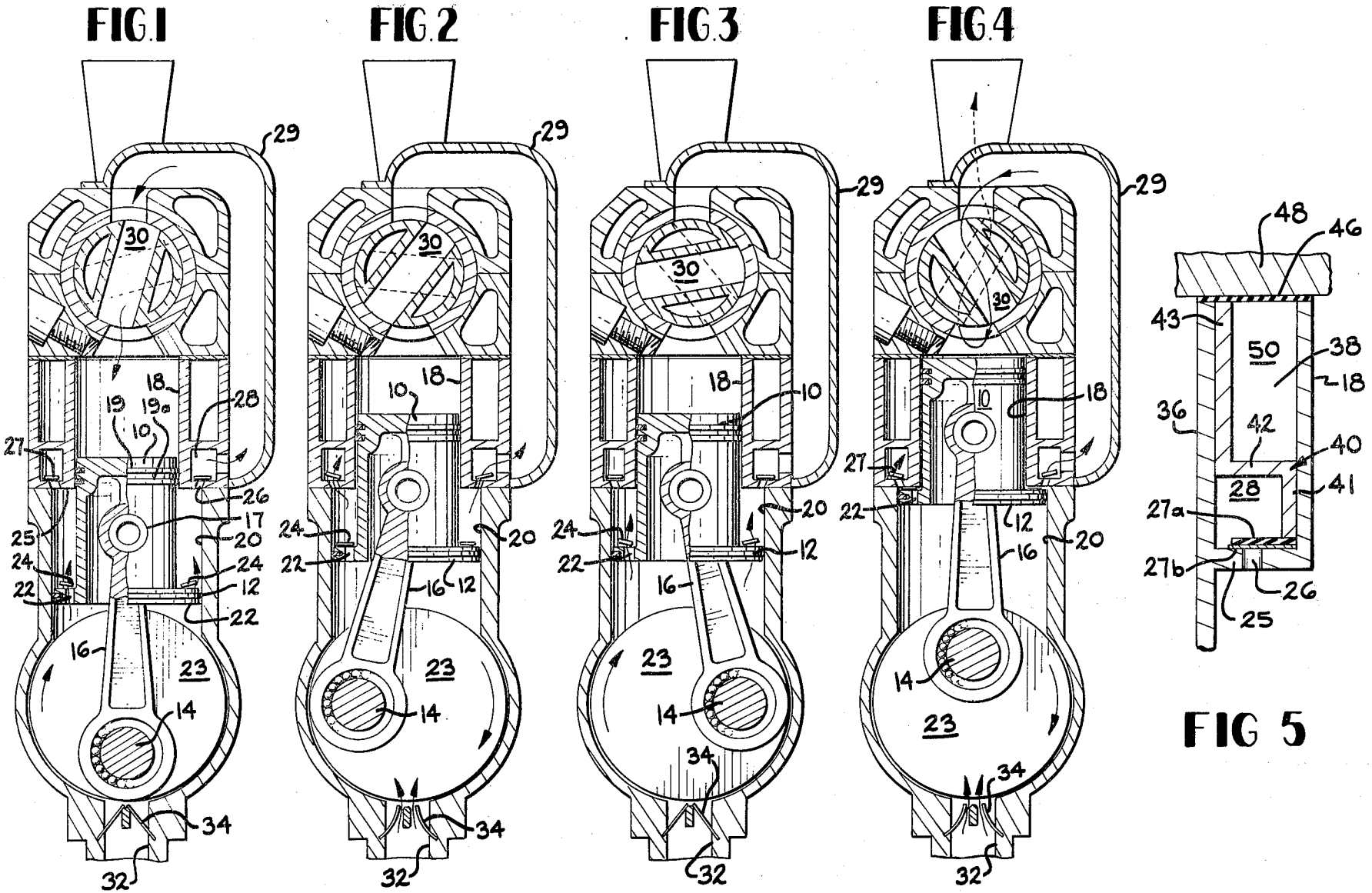
FIGS. 1–4 inclusive are side elevations partially in section showing the intake, compression, power and exhaust strokes, respectively of a preferred embodiment of the present invention.
FIG. 5 is a partial cross-section of the engine of FIGS. 1-4 showing a preferred construction of the engine block.

A preferred embodiment of the engine of the present invention having a single cylinder is shown in FIGS. 1–4 and includes a piston 10 having an enlarged stepped portion 12 at its lower end. The piston is arranged to drive a crankshaft 14 through a connecting rod 16 and wrist pin 17 all of conventional design. The upper portion of the piston 10 reciprocates within the combustion chamber cylinder 18 and includes grooves for receiving upper and lower sealing piston rings 19 and 19*a*. The annular stepped portion 12 of the piston is carried by and preferably formed integrally with the upper portion of the piston and works within the enlarged area cylinder defined by the walls 20. The stepped portion of the piston includes passageways 22 for the admission of a fuel-air mixture from the crankcase 23 of the engine into the compressor chamber defined by cylinder walls 20, the annular piston stepped portion 12 of the piston 10 and the annular shoulder 25 at the lower end of the cylinder wall 18. Passageways 26 are provided through the stepped portion 25 of the cylinder and are closed by one way check valves 27. At least one passageway 26 and check valve 27 are provided with a plurality approximately evenly spaced about the shoulder 25 typically being preferred depending on the size and performance characteristic of the engine.

Passageways communicate between the compressor chamber and a manifold typically comprising an annular collector chamber 28 circumadjacent the shoulder 25 and in open communication with an accumulator/-manifold 29. One end of the manifold 29 is in periodic communication with the combustion chamber of the engine via an intake valve 30. The valve 30 may take any desired form; for many applications it will preferably be in the form of a rotary valve as shown to take advantage of the known benefits of such a valve. Poppett and other types of valves may also be used depending on the application and the preferences of the designer. Exhaust from the engine is also controlled by the rotary valve 30 which is shown in FIG. 4 in a portion of the exhaust cycle as will hereinafter be explained in more detail.

Air for combustion normally in the form of a fuel-air mixture is provided via a carburetor or the like (not shown) through a passageway 32. Check valves 34 are optionally, but preferably, used to prevent backflow to the carburetor. Alternatively fuel injectors, not shown, can be used to inject fuel into the combustion chamber in the known manner; e.g., for a Diesel engine.

A preferred arrangement for the portion of the engine block defining the collector chamber 28 is shown in more detail in FIG. 5. The combustion chamber cylinder is provided as part of the engine block and is supported from the outer wall 36 thereof by the shoulder 25. An open-topped annular cavity 38 is thus provided. A plurality of passages 26 are provided in the shoulder 25 and the check valve 27 is an annular disc fitting in the bottom of the cavity 28. A particularly preferred form of check valve 27 comprises an upper disc 27*a* of rubber or the like and a lower disc 27*b* of thin beryllium alloy spring stock.

The inner circumference of the disc 27 is clamped to the shoulder 25 by the sleeve 40 and more particularly by the reduced diameter cylindrical end 41 thereof which is slidingly fit over the cylinder 18. Cylinder 41 terminates at its upper end in a radial shoulder 42 which bridges to the enlarged diameter cylinder 43. Cylinder 43 slidingly fits within the outer wall 36 and sealingly engages the cylinder head gasket 46 against the valve containing engine head 48.

Because the sleeve 40 is sealed at each end it divides the cavity 38 into two separate cavities, the collector chamber 28 and the annular cavity 50 which is connected to a source of circulating cooling water.

Figure 6:
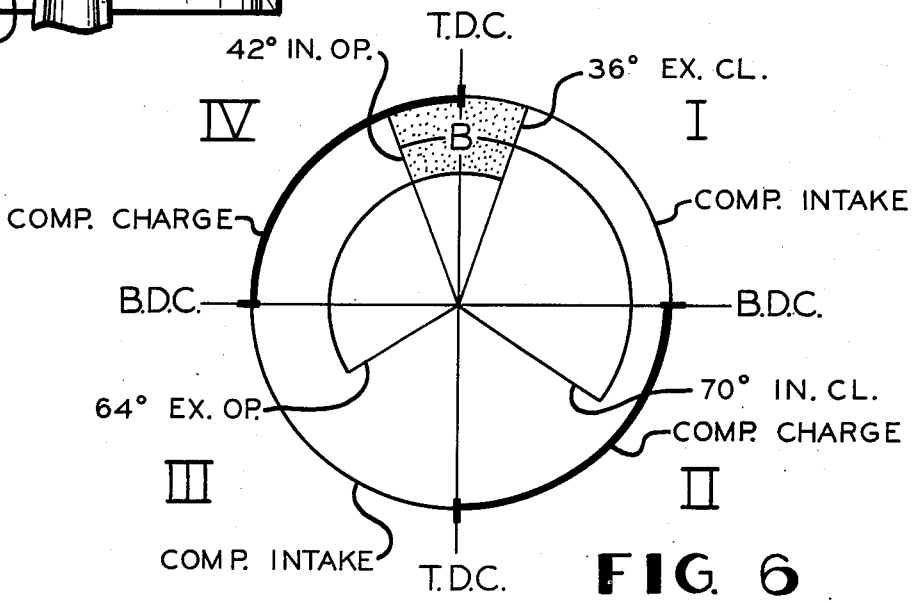
FIG. 6 is a timing diagram illustrating the operation of the engine of FIGS. 1–4.

FIG. 6 illustrates the operation of the engine through a complete combustion cycle. In order to illustrate the operation of the compressor, the operation of the engine from top dead center to top dead center is represented by 180° on the timing diagram rather than the usual 360°. Thus a full combustion cycle is comprised of an engine intake stroke generally occurring in the first quadrant (I) of the timing diagram, a compression stroke (quadrant II) a power stroke (quadrant III) and an exhaust stroke (quadrant IV).

The specific preferred embodiment of the invention associated with the timing chart of FIG. 5 is a high performance engine having substantial valve overlap. More particularly, the intake valve opens 42° before top dead center and closes 70° after bottom dead center while the exhaust valve opens 64° before bottom dead center of the power stroke and does not close until 36° after top dead center on the exhaust stroke.

The operation of the compressor section of the present invention is also shown in FIG. 5. The check valves for the compressor are controlled only by the gas forces on them, inertia and the movement of the piston. Thus they will open and close at substantially the top and bottom dead center positions of the piston.

It will, by now, be appreciated that the compressor section of the engine provides two charges of combustion mixture to the combustion chamber for each combustion stroke. The fuel-gas mixture in the crankcase 23 is typically admitted from a carburetor (not shown) through the passageway 32 and past the check valves 34 at substantially atmospheric pressure (14.7 PSIA) although, as mentioned above, the fuel may be provided separately to the combustion chamber.

Assuming the provision of an atmospheric fuel-air mixture to the crankcase, the compressor section is initially filled with a combustion mixture at 14.7 PSIA. Two "charges" of the compressor are provided to the combustion chamber on each engine intake stroke. Thus the theoretical charge pressure, assuming no valve overlap, is given by:

$$P_E = 2 \times (V_c / V_E \times 14.7 \ PSIA$$

where $P_E$ is the engine combustion chamber pressure, $V_E$ is the engine combustion chamber volume and $V_c$ is the compressor volume. It will be apparent that supercharging occurs for any engine geometry wherein the compressor volume is greater than one-half the combustion chamber volume. Typically a lower limit for a practical engine will be a compressor volume equal to approximately three-fourths the volume of the combustion chamber.

In the preferred embodiment illustrated the volumes of the engine combustion chamber and the compressor are equal, making the theoretical (assuming no valve overlap) charge pressure about 29 PSIA. In actual practice, because of the valve timing as shown in FIG. 5, a charge pressure of somewhat less than this can be expected but even with the relatively high valve overlap (indicated by "B" for blowdown on FIG. 6) chosen for this embodiment a substantial amount of supercharging is provided.

Figure 9:
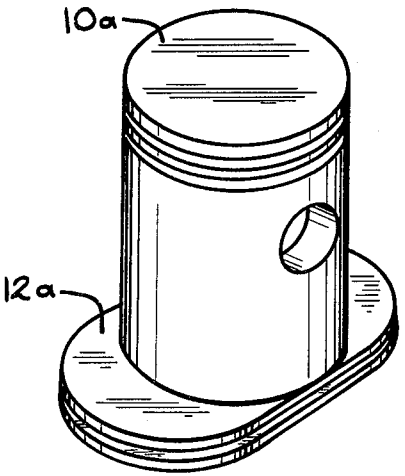
FIG. 9 is an isometric view of the piston of FIGS. 7 and 8.
Figure 8:
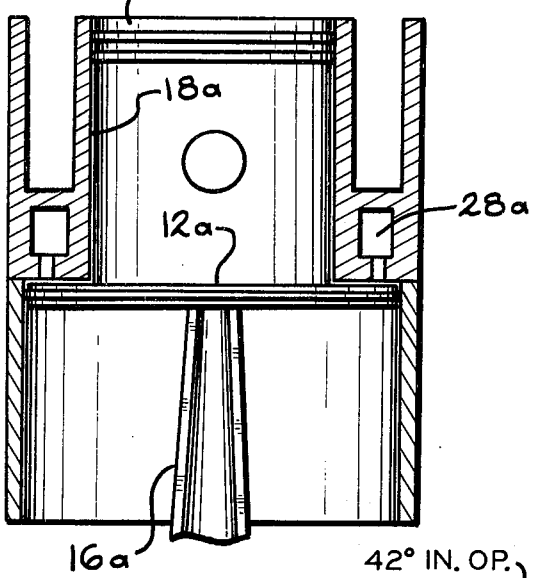
FIG. 8 is a side elevation of the piston and cylinder of FIG. 7 partially in section.
Figure 7:
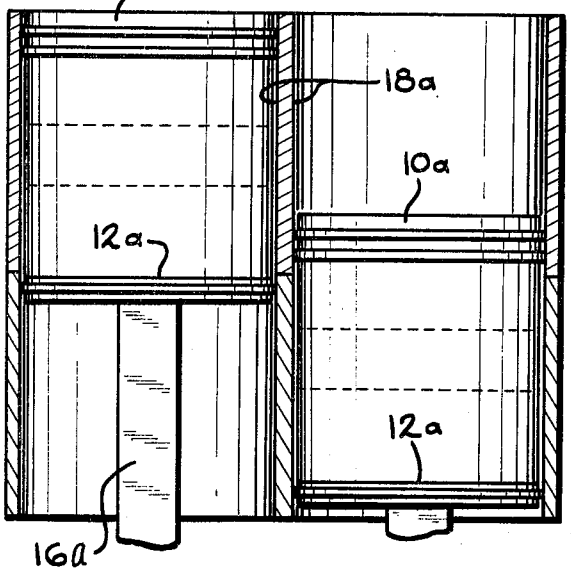
FIG. 7 is a partial elevation view of a preferred piston and cylinder arrangement for a multi-cylinder engine according to the present invention.

FIGS. 7 through 9 illustrate a preferred multicylinder embodiment of the present invention in diagrammatic form. To minimize the size and weight of such an engine it is preferred to utilize the minimum spacing between adjacent combustion cylinders. To this end, as shown in FIG. 9, the compressor piston **12*a* is elongate with an axial extent (along the line of cylinders) equal to the piston diameters and extending transversely of the engine. Thus, as shown in FIG. 7, the adjacent pistons can be axially adjacent without the need for any additional spacing to accomodate the stepped portion of the piston. As shown in FIG. 8 a collector chamber 28*a* is preferably provided above each stepped portion. Manifolding in any convenient way suitable to the overall engine geometry is provided to communicate between the collector chambers 28*a* and the combustion chamber. In some applications it will be preferred to provide a relief in the cylindrical body of the main portion of the piston just above the stepped portion 17*a*, thereby allowing the use of a single collector 28*a***.

Figure 10:
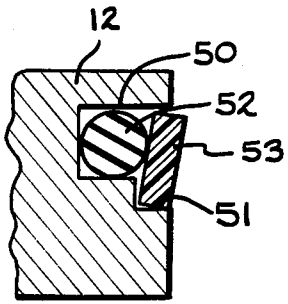
FIG. 10 is a detail of a preferred seal for the compressor of the present invention.

FIG. 10 illustrates a preferred seal arrangement for the compressor piston 12 or **12*a*. A circumferential groove 50 is provided in the piston 12 including a stepped area 51 of reduced radial depth. An "O" ring 52 of any suitable rubber or rubber-like material fits within the groove 50 and provides a resilient biasing of the seal element 53** comprising a continuous ribbon of rectangular cross-section of polytetraflouroethylene or the like.

OPERATION

Reference is made again to FIGS. 1–4 inclusive for a description of the operating cycle of the engine. In FIG. 1, the piston is at its lowermost position just prior to starting the compression stroke. During the previous 180° of crankshaft revolution the piston was moving downwardly from top dead center position and the check valve 24 was open to permit air or a fuel-air mixture from the crankcase to enter the compressor. During the same time, the inlet portion of rotary valve 30 was opened and the charge previously contained in the manifold 26 was aspirated into the cylinder 18. In FIG. 2, the crankshaft has rotated 90° from the position of FIG. 1, the valves 24 and 30 have closed and the stepped portion 12 of the piston 10 is on its first of two compression strokes of the engine combustion cycle delivering a compressed fuel-air mixture to the manifold 29 through the now opened valve 27. In FIG. 3, the charge in the main cylinder has been ignited and the piston has started its downward power stroke opening the check valve 24 for the admission of a fresh charge of air or fuel-air mixture into the compressor. FIG. 4 illustrates the piston at top dead center position at the conclusion of the exhaust stroke of the cycle which is also the completion of the second compression stroke. Thus, it will be seen that there are two compression strokes of the stepped portion of the piston per combustion cycle of the engine. It is not believed that there is any critical ratio between the volumes of the compressor and that of the combustion chamber of the engine. The relative volumes can be varied as required to provide the degree of supercharge desired. The one to one volume ratio of the chamber volumes and consequent two to one compression ratio is preferred.

The volume of the manifold affects the operation primarily as it determines the time required to reach the same steady state operating pressure. In other words, if the manifold volume is relatively small, the same operating pressure will be reached with fewer strokes than if the manifold volume, for example, is substantially greater than the volume of the compression cylinder. The end result, however, is the same for any given engine in that the same pressure is always reached regardless of manifold size or engine speed. It is preferred that the manifold volume be on the same order of magnitude as the compressor and the combustion chamber.

Many variations of the present invention will occur to those skilled in the art. For example, and as mentioned briefly above, the supercharger of the present invention can be used with fuel injected gasoline engines or diesel engines. While a rotary valve assembly has been shown and described, it will be obvious that other known valve structures can be substituted. Similarly the engine timing, amount of supercharge and many other features of the overall engine can vary from the foregoing description of the preferred embodiments without departing from the spirit and scope of the invention as defined in the following claims.

What is claimed is:

1. In a four stroke internal combustion engine comprising a combustion chamber defined by a cylinder and an engine piston mounted for reciprocation within said cylinder, and a crankcase, said engine piston operating with separate and distinct exhaust, intake, compression and power strokes for each engine cycle, said exhaust and compression strokes occurring upon separate strokes of said engine piston in one direction and said intake and power strokes occurring upon separate strokes of said engine piston in another direction, the improvement comprising: a compressor having a compressor piston carried with said engine piston and a compressor cylinder sealingly receiving said compressor piston and forming therewith a compressor chamber; means for admitting a charge of air from said crankcase to said compressor chamber on each of said intake and power strokes of said piston; means for receiving said charge of air from said compressor chamber on each of said exhaust and compression strokes of said engine piston and delivering two of said charges to said combustion chamber substantially during said intake stroke of each engine cycle; said compressor chamber having a volume greater than one-half the volume of said combustion chamber whereby said compressor provides a supercharger to deliver air to said combustion chamber at a higher pressure than said air is delivered to said supercharger.

2. The engine of claim 1 wherein said compressor chamber and said combustion chamber are of approximately equal volumes.

3. The engine of claim 1 wherein said engine piston is circular in cross-section and said compressor piston is elongate having a minor dimension substantially the same as the diameter of said engine piston.

4. The engine of claim 2 wherein said engine piston is circular in cross-section and said compressor piston is elongate having a minor dimension substantially the same as the diameter of said engine piston.

5. The engine of claim 1 wherein said means for admitting a charge of air to said compressor chamber comprises a check valve in said compressor piston communicating between said crankcase and said compressor chamber for one-way flow from the former to the latter.

6. The engine of claim 2 wherein said means for admitting a charge of air to said compressor chamber comprises a check valve in said compressor piston communicating between said crankcase and said compressor chamber for one-way flow from the former to the latter.

7. The engine of claim 3 wherein said means for admitting a charge of air to said compressor chamber comprises a check valve in said compressor piston communicating between said crankcase and said compressor chamber for one-way flow from the former to the latter.

8. The engine of claim 4 wherein said means for admitting a charge of air to said compressor chamber comprises a check valve in said compressor piston communicating between said crankcase and said compressor chamber for one-way flow from the former to the latter.

* * * * *